United States Patent [19]

Polis et al.

[11] Patent Number: 4,662,480

[45] Date of Patent: May 5, 1987

[54] ELEVATOR SYSTEM

[75] Inventors: Marjorie J. Polis, Byram; Alan L. Husson, Long Valley, both of N.J.

[73] Assignee: Westinghouse Electric Corp., Pittsburgh, Pa.

[21] Appl. No.: 826,957

[22] Filed: Feb. 7, 1986

[51] Int. Cl.[4] ..... B66B 1/18

[52] U.S. Cl. ..... 187/126

[58] Field of Search ..... 187/29 R

[56] References Cited

U.S. PATENT DOCUMENTS

| | | | |
|---|---|---|---|
| 3,236,332 | 2/1966 | Burgy et al. | 187/29 R |
| 4,147,235 | 4/1979 | Henry et al. | 187/29 R |
| 4,352,412 | 10/1982 | Bittar et al. | 187/29 R |
| 4,431,085 | 2/1984 | MacDonald | 187/29 R |
| 4,448,286 | 5/1984 | Kuzunuki et al. | 187/29 R |
| 4,520,905 | 6/1985 | Sasao | 187/29 R |

*Primary Examiner*—William M. Shoop, Jr.
*Assistant Examiner*—W. E. Duncanson, Jr.
*Attorney, Agent, or Firm*—D. R. Lackey

[57] ABSTRACT

An elevator system in which hall calls from an independent inconspicuous riser (IR) are handled by the same dispatcher as hall calls from the normal hall call riser. Each floor of the building is assigned its own unique timing scan slot position for detecting normal hall calls, with the number of scan slots being at least twice the number of floors in the building. IR calls appear in scan slot positions for floors which are not in the actual building, and the dispatching function treats the building as though it had twice its actual number of floors. A car on IR duty translates its advanced car position into the imaginary portion of the building, before sending its advanced position signal to the dispatching function. When a car on IR duty receives an assignment from the dispatching function, its associated car controller translates an assignment for a fictitious floor to an actual floor of the building, and it utilizes its actual advanced car position in the process of serving the IR call.

8 Claims, 6 Drawing Figures

NORMAL MEMORY TRACK 30
MEMORY MAP-PER CAR
NORMAL-ALL CARS-
( IR NOT ACTIVATED)

| | | | | | | | | | | | | | | |
|---|---|---|---|---|---|---|---|---|---|---|---|---|---|---|
| MT00 (UP) | 1 | 1 | 1 | 1 | 1 | 0 | 0 | 0 | 0 | 0 | 0 | 0 | 0 | 0 |
| MT01 (DN) | 0 | 1 | 1 | 1 | 1 | 1 | 0 | 0 | 0 | 0 | 0 | 0 | 0 | 0 |
| SCAN SLOTS | 00 | 01 | 02 | 13 | 14 | 15 | 16 | 17 | 18 | 29 | 30 | 31 | | |
| FLOOR # | 1 | 2 | 3 | 14 | 15 | 16 | 1 | 2 | 3 | 14 | 15 | 16 | | |

IR MEMORY TRACK 32
MEMORY MAP - PER CAR
IR ACTIVATED
IR CAR(S) ONLY

| | | | | | | | | | | | | | | |
|---|---|---|---|---|---|---|---|---|---|---|---|---|---|---|
| MT00 (UP) | 0 | 0 | 0 | 0 | 0 | 0 | 1 | 1 | 1 | 1 | 1 | 0 | | |
| MT01 (DN) | 0 | 0 | 0 | 0 | 0 | 0 | 0 | 1 | 1 | 1 | 1 | 1 | | |
| SCAN SLOTS | 00 | 01 | 02 | 13 | 14 | 15 | 16 | 17 | 18 | 29 | 30 | 31 | | |
| FLOOR # | 1 | 2 | 3 | 14 | 15 | 16 | 1 | 2 | 3 | 14 | 15 | 16 | | |

ELEVATOR SYSTEM

BACKGROUND OF THE INVENTION

1. Field of the Invention

The invention relates in general to elevator systems, and more specifically to elevator systems having a plurality of elevator cars under group supervisory control by a system processor or dispatching function.

2. Description of the Prior Art

In a typical elevator system having a plurality of elevator cars under group supervisory control, all hall calls are normally treated alike from a priority view point, unless they are from a special pre-defined floor, such as a lobby floor, a convention floor, or the like; or, the call has been registered beyond a predetermined period of time, i.e., a timed-out call. It is sometimes desirable to provide immediate priority service for a hall call by providing a riser of hall call pushbuttons which are independent of the normal hall call pushbuttons. The pushbuttons of the independent riser are placed in an inconspicuous location; thus, the term "inconspicuous riser" or IR. Calls register on the inconspicuous riser are ignored by the dispatcher function unless the IR feature is activated, such as by a switch in the traffic director's station (TDS). When the IR switch is moved to the "activated" position, a predetermined car, or cars, is removed from group control as soon as it serves any car calls it may already have registered. This IR car will then respond only to hall calls placed on the IR riser, for as long as the IR feature is selected, with a separate dispatcher function handling the IR calls. The hall lanterns are not activated by IR cars serving IR calls. Since the addition of a second dispatcher adds substantially to the cost of implementng the IR feature, it would be desirable to be able to handle an IR riser with the same dispatching function that handles the normal hall call riser, if this result can be achieved without degradation of elevator service to hall calls registered on the permanently enabled riser.

SUMMARY OF THE INVENTION

Briefly, the present invention is an elevator system having a plurality of elevator cars mounted in a building, with each car being controlled by an associated car controller, and further including first and second independent risers of hall call pushbuttons. The first riser, which is the normal riser, is always enabled. The first riser handles front door hall calls, and if the car has a rear door, it will also handle rear door hall calls. The second riser, which is an inconspicuous riser (IR), is selectively enabled, such as by a switch. When the second riser is enabled, one or more elevator cars are selected for exclusive second riser service. The car controllers of the elevator cars define the building configuration for a supervisory processor or dispatching function, with each car controller supplying the supervisory processor with its own set of enables which set forth the floors of the building that the associated elevator car is enabled to serve. A single dispatching function serves both the first and second independent risers by having the car controller of each car activated for exclusive second riser service indicate that it is enabled for fictitious floors, i.e., floors which are not in the building. Also, while the IR feature is active, each IR car increments its advanced car position into the fictitious portion of the building before sending the car position signal to the dispatching function. The advanced car position of an elevator car is the floor at which it is located, when the car is stationary, and it is the floor at which the elevator car can make a normal stop, when it is moving. If the building has N floors, the fictitious floors are created by adding N to each actual floor number the IR car is enabled to serve. Also, the advanced car position is incremented by N. Thus, the dispatching function, when the second riser calls are enabled, applies its call answering strategy to a building having twice the actual number of floors. The first riser is associated with the actual floors of the building, and the second riser is associated with a "phanton extension" of the building, which extension has the same number of floors as the actual building. When an elevator car assigned to second riser service receives an assignment from the dispatcher for a fictitious floor, its car controller automatically translates the fictitious floor assignment to an assignment for an actual floor of the building, by subtracting N from the assignment floor number.

BRIEF DESCRIPTION OF THE DRAWINGS

The invention may be better understood, and further advantages and uses thereof more readily apparent, when considered in view of the following detailed description of exemplary embodiments, taken with the accompanying drawings, in which.

DESCRIPTION OF THE PREFERRED EMBODIMENTS

The present invention relates to an elevator system having a bank of elevator cars under group supervisory control by a system processor or dispatching function. The elevator system is of the type disclosed in U.S. Pat. No. 4,037,688, wherein the dispatching function is universal, i.e., the car controllers of the elevator cars have memory tracks set to indicate which floors of the building they are enabled to serve and the system processor or dispatching function "builds" the building configuration existing at any instant, by storing these floor enables from all in-service elevator cars in a random access memory (RAM). Thus, the dispatching function is not designed for a specific building, but can be used with any building configuration without modification. In order to simplify the present description, U.S. Pat. No. 4,037,688 is hereby incorporated into the present application by reference.

Figure 1:
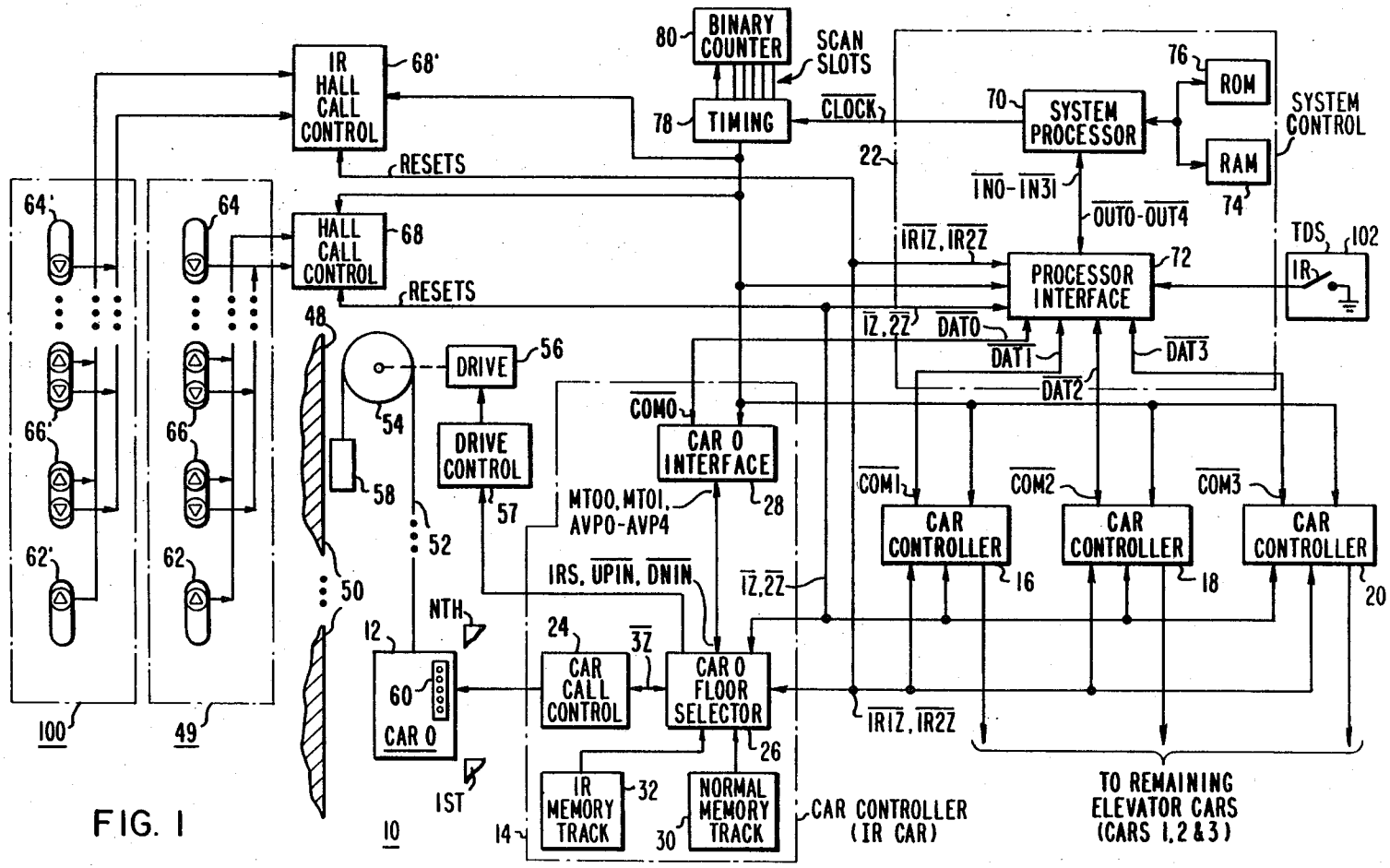
FIG. 1 is a partially schematic and partially block diagram of an elevator system which may be constructed according to the teachings of the invention.

FIG. 1 is similar to FIG. 1 of the incorporated U.S. Patent, except modified to include a second or inconspicuous riser (IR) 100 of hall call pushbuttons, in addition to the normal riser 49 of hall call pushbuttons, and also by adding a traffic director station (TDS) 102 having a switch IR. Switch IR, when closed, enables calls registered on the IR riser 100 to be served by a preselected car, or cars. When switch IR is open, hall calls registered on the second riser 100 are ignored.

More specifically, FIG. 1 illustrates an elevator system 10 having a single bank of elevator cars, with the car controllers 14, 16, 18 and 20 for four cars being illustrated for purposes of example. Only a single car 12 is illustrated, associated with car controller 14, in order to simplify the drawing, since the remaining cars would be similar. Each car controller includes a car call control function, a floor selector function, a memory function which provides floor enable signals, and an interface function for interfacing with supervisory system control 22, also called a dispatching function. For example, car controller 14 includes car call control 24, a floor selector 26, an interface circuit 28 and memory tracks 30 and 32. The supervisory system control 22 provides the operating strategy of the elevator system which directs the elevator cars to efficiently serve calls for elevator service.

Car 12 is mounted in a hatchway 48 for movement relative to a building 50 having a plurality of floors or landings N. Car 12 is supported by a plurality of wire ropes 52 which are reeved about a traction sheave 54 mounted on the shaft of a suitable traction drive motor 56. Drive motor 56 is controlled by drive control 57. A counterweight 58 is connected to the other ends of the ropes 52.

Car calls, as registered by pushbutton array 60 mounted in the car 12, are recorded and serialized in the car control 24, and the resulting serialized car call information 3Z is directed to the floor selector 26.

Up and down hall calls are registered in a first or normal riser 49 of pushbuttons mounted on the hallways, such as the up pushbutton 62 located at the bottom floor, and down pushbutton 64 located at the top floor, and the up and down pushbutton 66 located at the intermediate floors. The hall calls may be read in parallel from a call registration module, or they may be recorded and serialized in hall call control 68. The up and down hall calls 1Z and 2Z, respectively, are directed to the floor selectors of all of the elevator cars, as well as to the supervisory system control 22.

Up and down IR hall calls are registered by a second or inconspicuous priority riser 100 of pushbuttons mounted in the hallways. The IR hall calls may be read in parallel from a call registration module, or they may be recorded and serialized in IR hall call control 68'. The up and down hall calls 1R1Z and IR2Z, respectively, are directed to the floor selectors of the elevator cars, such as floor selector 26 of car 12, as well as to supervisory control 22. The IR hall calls are only served when switch IR in the traffic director's station 102 is closed. The position of switch IR, for example, may be detected by system control 22 and an appropriate signal sent to the car controllers 14, 16, 18 and 20 as part of command signals COM0, COM1, COM2 and COM3, respectively.

Floor selector 26 keeps track of the position of elevator car 12, and it prepares a binary advanced car position signal AVP0–AVP4 for use by the system control 22. Floor selector 26 also keeps track of calls for service for its associated car, and it provides signals for controlling the drive control 57. Floor selector 26 also provides signals for controlling such auxiliary devices as the door operator and hall lanterns, and it provides resets for resetting the car call control 24 and the hall call controls 68 and 68' when a car call or hall call has been serviced. Any suitable floor selector may be used. For example, the floor selector disclosed in U.S. Pat. No. 3,750,850 may be used, which patent is assigned to the same assignee as the present application. U.S. Pat. No. 3,750,850 describes a floor selector for operating a single car, without regard to group operation. U.S. Pat. No. 3,804,209 discloses modifications to the floor selector of U.S. Pat. No. 3,750,850, in order to adapt it for group control by a programmable system processor. These patents are hereby incorporated into the present application by reference.

The supervisory system control 22 includes a processing function 70, and an interface function 72. The processing function 70 is a programmable system processor, as indicated in FIG. 1, which operates in conjunction with a random-access memory (RAM) 74 and a read-only memory (ROM) 76. The processing function 70 receives car status signals from each of the car controllers, via the interface function 72, as well as the up and down hall calls from both risers 49 and 100, all as part of signals IN0–IN31, and the processing function 70 provides assignments for the various elevator cars by way of inhibit signals UPIN and DNIN. The assignments cause the elevator cars to serve hall calls according to a predetermined strategy. The car status signals provide information for the processing and dispatching function 70 relative to which floors each car is enabled to serve, and the processing function 70 then makes assignments to the cars based upon this car supplied information.

Supervisory system control 22 provides a timing signal CLOCK for synchronizing a system timing function 78. The system timing function 78 provides timing signals for controlling the flow of data between the various functions of the elevator system 10. Elevator system 10 is a serial, time multiplexed system, and precise timing is generated in order to present data in the proper timed relationship. A binary counter 80 repetitively divides successive-like periods of time into a predetermined plurality of scan slots. Each floor of the building is assigned its own time or scan slot in each repetitive time cycle. Scan slots are generated in cycles of 16, 32, 64, 128, etc. According to the teachings of the invention, a scan slot cycle having at least twice the number N of floors in the building 50 is selected. For purposes of example, it will be assumed that there are 16 floors in the building 50, so a cycle with 32 scan slots (0–31) would be selected. The 32 scan slot cycle is generated by a binary counter 80 having five outputs. Thus, the binary address of scan slot 00 is 00000, the binary address of scan slot 01 is 00001, etc.

Figures 2, 4, 5:
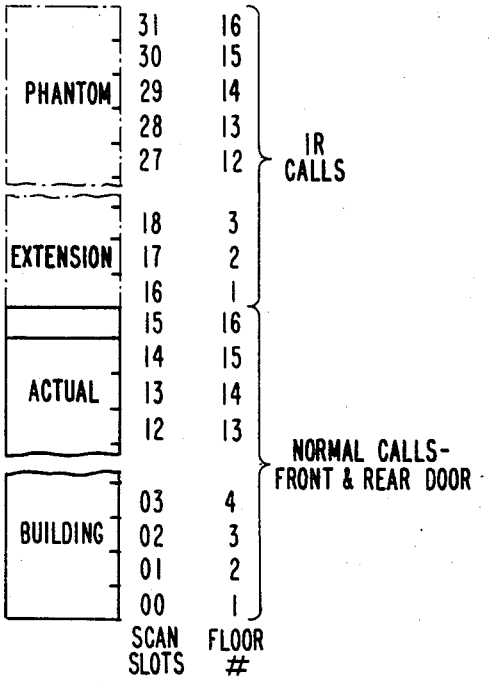
FIG. 2 illustrates diagrammatically how activation of the IR feature according to the teachings of the invention has the effect of doubling the number of floors in the building, from the viewpoint of the dispatching function.
FIG. 4 is a map of a memory location associated with each elevator car of the elevator system, illustrating an example of the floor enables sent to the dispatching function when the IR feature is not active.
FIG. 5 is a map of an additional memory location associated with each elevator car which can be switched to IR duty, with the floor enables illustrated in FIG. 5 being an example of the floor enables which are sent to the dispatching function, instead of those shown in FIG. 4, while the IR feature is active.

According to the teachings of the invention, normal front (and rear) door hall calls registered on riser 49 from floors 1–16 appear in scan slots 00 through 15, respectively. Hall calls registered from floors 1–16 via the second or inconspicuous riser 100 appear in scan slots 16–31, respectively. This arrangement is set forth diagrammatically in FIG. 2, with the building appearing to the system control 22 as though it had 16 floors when the IR feature is inactive, and 32 floors when the IR feature is active. When the IR feature is active, the fictitious floors added to the building create a phantom extension having the same number of floors as the number of floors in the actual building.

Figure 3:
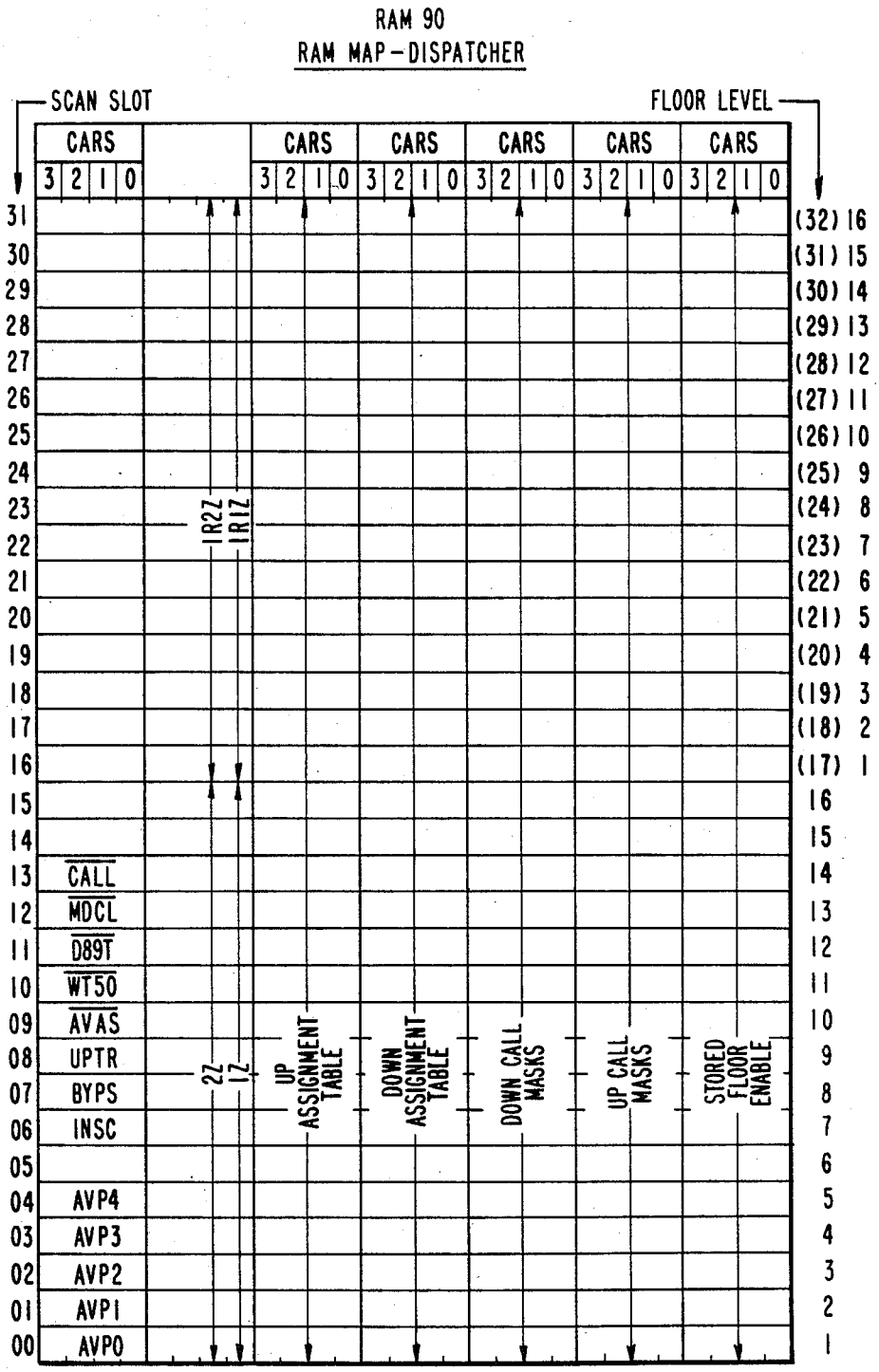
FIG. 3 is a RAM map of a memory maintained by the dispatching function, wherein the dispatching function configures the building according to floor enables received from all in-service elevator cars.

System control 22 maintains a random access memory (RAM) 74, a portion of which is shown in FIG. 3. FIG. 3 is similar to FIG. 5 of the incorporated U.S. Pat. No. 4,037,688. Each elevator car has a normal memory track 30 shown in FIGS. 1 and 4. A car (or cars) which is pre-selected for exclusive service to calls registered from the second riser 100, when IR switch is closed, also includes the IR memory track 32 shown in FIGS. 1 and 5. When switch IR is open, all elevator cars send the memory track 30 of FIG. 4 to the system control 22, and when switch IR is closed, an IR car sends the memory track 32 of FIG. 5. The memory track 30 of FIG. 4 contains the normal floor enables for the first riser 49. These floor enables appear in scan slos 0–15, and none of the scan slots 16–31 are enabled. The memory track 32 of FIG. 5 contains the floor enables for the second riser 100. These floor enables appear in scan slots 16–31, and none of the scan slots 0–15 are enabled in the memory track of FIG. 5.

Memory track signals MT00 and MT01 for the up and down service directions, respectively, are sent to car interface 28 from floor selector 26, interface 28 sends the floor enables to processor interface 72 as part of signal DAT0, and processor interface 72 sends the floor enables to system processor 70 as part of signals IN0–IN31. As shown in the RAM map of FIG. 3, system processor 70 stores the floor enables, and from the floor enables up call masks and down call masks are prepared and stored. Processor 70 uses these masks, the car position signals, and the active hall calls, 1Z, 2Z, IR1Z and IR2Z stored in RAM to prepare up and down assignments for each of the elevator cars. These assignments are made by preparing inhibit signals for the various elevator cars. If a car is assigned to handle an up hall call which may be registered from the third floor, for example, this assignment is made by inhibiting the non-assigned cars from "seeing" an up call from the third floor. These inhibits are sent from the system processor 70 to the processor interface 72 as part of command words OUT0–OUT4. The processor interface 72 sends the inhibit signals to each car controller interface as part of signals COM0–COM3, and the car interface 28 sends up and down inhibit signals UPIN and DNIN for the proper floors to the floor selector 26.

Figure 6:
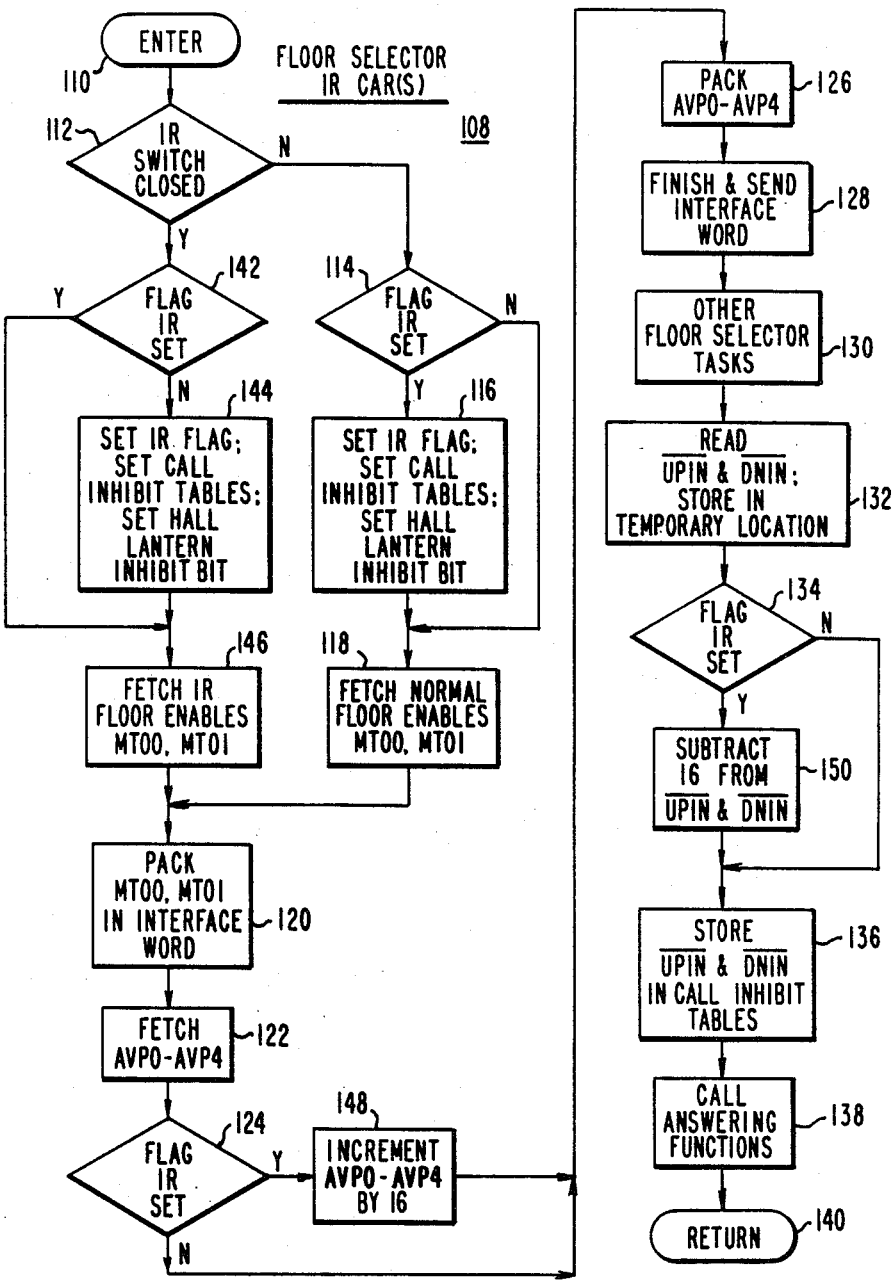
FIG. 6 is a flow chart illustrating how the floor selector of an elevator car which may be assigned to IR duty may be modified.

FIG. 6 sets forth a program 108 which illustrates how the floor selector function 26 of each IR car may be modified according to the teachings of the invention. No modification of the system control 22 is required, as the system control 22 is universal in nature, i.e., it does not require tailoring to any specific building configuration. No modification is required to the floor selectors of non-IR cars other than making the normal memory track 30 twice as long as would ordinarily be required, and loading the excess scan slots with zeroes to indicate non-enablement.

More specifically, the program of FIG. 6 is entered at 110 and step 112 checks to see if switch IR in TDS 102 is closed. Switch IR is closed when the IR feature is activated. For example, the switch indication may be made by a signal IRS which is a logic 1 when switch IR is closed and a logic 0 when switch IR is open. Signal IRS may be incorporated with signal COM0–COM3 sent by the processor interface 72 to the car interface 28, and the car interface 28 may separate signal IRS from the serial stream of signals and communicate it to the associated floor selector 26. It will first be assumed that switch IR is open. In order to determine if switch IR was just opened, i.e., if it was closed the last time program 108 was run, step 114 checks to see if a flag IR is set. Flag IR is stored in RAM associated with the floor selector function. If flag IR is set, it indicates that the IR feature was active during the last running of program 108, and has just been deactivated. In this situation, step 116 resets flag IR. Step 116 also sets the call inhibit tables to momentarily inhibit the elevator cars from seeing any hall calls, in order to provide time for the system processor 70 to build a new building configuration, i.e., the up and down call assignment tables shown in FIG. 3 are set to inhibit the cars from seeing hall calls from any riser. Also, a hall lantern inhibit bit for IR calls, which is stored in RAM, is reset. Step 118 fetches the normal floor enables MT00, MT01, i.e., the floor enable memory track 30 shown in FIG. 4. If flag IR is not set, step 114 bypasses step 116, proceeding directly to step 118.

Step 120 packs the floor enables MT00–MT01 in the proper location in a binary word destined for the car interface 28, and step 122 fetches the binary advanced car position signal AVP0–AVP4. Step 124 checks flag IR. Flag IR will now be found to be reset, the step 126 packs AVP0–AVP4 in the interface word. Step 128 completes and sends the interface word to the car interface 28. The floor selector 26 may then to on to other tasks, indicated generally at step 130, or into a time delay loop, in order to enable the system control 22 to build the new building configuration, and to prepare and send inhibit assignments to the various elevator cars.

Step 132 then reads the up and down inhibits UPIN and DNIN, respectively, i.e., the inhibit assignments from system control 22, and the inhibit assignments are stored in a temporary location in RAM. Step 134 checks flag IR. Flag IR will be found to be reset at this point, and step 134 proceeds to step 136 which stores the floor inhibit signals in appropriate hall call inhibit tables in RAM. Step 138 proceeds with the normal call answering functions of a floor selector, and the program returns to the start 110 from exit 140, or to a priority executive if the processor which runs program 108 is also assigned to tasks other than the floor selector function.

When switch IR is closed by an attendant at the traffic director's station 102, to activate the IR feature, step 112 will now branch to step 142 which checks flag IR. If flag IR is not set, it indicates switch IR was open the last time it was checked. Step 142 proceeds to step 144 when flag IR is not set. Step 144 sets flag IR, it sets the inhibit tables for the purpose explained relative to step 116, to enable the building to be reconfigured, and it sets the hall lantern inhibit bit for IR calls so the hall lanterns are not illuminated when IR calls are being served. Step 144 then proceeds to step 146 which fetches the IR floor enable memory track 32 shown in FIG. 5.

Step 120 packs the IR floor enable signal MT00 and MT01 in the interface word, and step 122 fetches the advanced car position signal AVP0–AVP4. Step 124 will now find flag IR set, and step 148 increments the advanced car position signal AVP0–AVP4 by N, the number of floors in the building, which in the present example is 16. Step 126 packs the modified advanced car position signal AVP0–AVP4 into the interface word, and the program continues as hereinbefore described through steps 128, 130 and 132. Step 134 will now find flag IR set, and step 150 subtracts N, i.e., 16 in the present example, from the up and down floor inhibit assignment signals UPIN and DNIN, respectively. Step 136 stores the modified assignments, and then proceeds to step 138. Step 138 performs the normal call answering functions of the floor selector.

In summary, the elevator system of the present invention handles the normal riser of front and rear door hall call pushbuttons, and also a separate inconspicuous priority riser (IR) of hall call pushbuttons, all with a single dispatching function. Further, no modification is required to the dispatching function. The car controllers of the controlled bank of elevator cars notify the dispatching function which floors they are enabled to serve, and the dispatching function configures the building accordingly. When the additional riser is activated, such as by a switch, each car pre-selected to serve IR calls notifies the dispatching function that it is enabled to serve floors which are ot actually in the building. For example, if there are N actual floors in the building, an IR car notifies the dispatching function that it is enabled to serve floors N+1 to 2N. Also, each IR car, before sending its building position to the dispatching function, adds N to its advanced car position signal. The dispatching function reconfigures the building in its RAM and makes assignments to the IR car or cars for floors N+1 to 2N. Upon receiving such assignments, each IR car subtracts N from the assignment. Thus, the full power of the dispatching strategy of a single dispatching function is simultaneously applied to two independent risers of hall call pushbuttons. Even though the dispatcher function will not normally assign the same scan slot to two cars, this effect is achieved without modification of the dispatcher, because the dispatcher is "tricked" into assigning two different scan slots associated with the same floor.

We claim as our invention:

1. An elevator system, comprising:

a building having a plurality of floors, a plurality of elevator cars, means mounting said plurality of elevator cars in said building for movement relative to the floors, first and second independent risers of up and down hall call registering means at the floors for registering calls for elevator service in the up and down service directions, respectively, means for selecting a predetermined car, or cars, (IR car) to serve only second riser calls when it is desired that such calls be served, car controller means for each of said plurality of elevator cars, each of said car controller means providing enable signals indicative of the floors, and service directions therefrom, the associated elevator car is capable of serving, with each IR car, when selected for second riser service, indicating it is enabled for fictitious floor which are not in the building, and supervisory control means responsive to said first and second riser of up and down hall call registering means and to the floor enable signals provided by each of said car controller means, said supervisory control means including storage means for storing said floor enable signals to obtain the building configuration existing at any instant, as defined by the car controller means of said plurality of elevator cars, said supervisory control means effectively assigning calls for elevator service registered on said first and second risers of up and down hall call registering means to predetermined cars, using the building configuration stored in said storage means to determine which floors and service directions therefrom are currently in the building configuration, and which floors and service directions therefrom each of the cars is capable of serving, the car controller means of each IR car including means for translating an assignment to a fictitious floor to an actual floor of said building.

2. The elevator system of claim 1 wherein the supervisory control means includes means for dividing the up and down hall call registering means associated with the building configuration defined by the car controller means, including actual and fictitious floors, among all inservice elevator cars enabled to serve them, and effectively assigning hall calls registered thereon by enabling selected elevator cars to serve calls registered on selected hall call registering means.

3. The elevator system of claim 1 including timing means which repetitively divides successive like periods of time into a predetermined plurality of scan slots equal to at least twice the actual number of floors in the building, with each floor in the defined building configuration, actual and fictitious, being assigned a different scan slot, and wherein the supervisory control means includes means dividing the scan slots associated with the floors among all of the in-service elevator cars and assigns the scan slots to the elevator cars, effectively assigning hall calls registered on the first and second risers of hall call registering means to the elevator cars by enabling an elevator car to answer a hall call associated with an assigned scan slot.

4. The elevator system of claim 3 wherein the building has N actual floors and the number of scan slots is at least 2N, with N adjacent scan slots being assigned to actual floors of the building, and with N different adjacent scan slots being assigned to fictitious floors when an IR car is selected for second riser service.

5. The elevator system of claim 1 wherein the car controller means associated with an IR car selectable for second riser service has first and second different sets of floor enables which respectively enable only actual and only fictitious floors, with the IR car selectable for second riser service outputting said second set of enables when actually selected for second riser service, and otherwise outputting said first set of floor enables.

6. The elevator system of claim 1 wherein the car controller means for each of the plurality of elevator cars includes memory means for storing the floor enabled signals indicative of the floors the associated elevator car is capable of serving, with each IR car having first and second different sets of floor enables stored in said memory means which respectively enable only actual and only fictitious floors of said building, with the car controller means outputting said second set of floor enables when its associated car is actually selected for second riser service, and otherwise outputting said first set of floor enables.

7. The elevator system of claim 1 wherein the car controller means for each of the plurality of elevator cars includes means for maintaining the advanced car position for its associated car, and wherein the car controller means for an IR car includes means for modifying the advanced car position, with the supervisory control means utilizing the modified advanced car position of an IR car on second riser service.

8. An elevator system, comprising:

a building having N floors, a plurality of elevator cars, means mounting said plurality of elevator cars in said building for movement relative to the floors, first and second independent risers of up and down hall call registering means at the floors for registering calls for elevator service in the up and down service directions, respectively, means for selecting a predetermined car, or cars, (IR car) to serve only second riser calls, when it is desired that such calls be served, car controller means for each of said plurality of elevator cars, each of said car controller means providing floor enable signals indicative of which of the N floors, and service directions therefrom, the associated elevator car is capable of serving, with the car controller means for an IR car, when selected for second riser service, indicating it is enabled for fictitious floors which are not in the building by incrementing each floor it is enabled to serve by N, each of said car controller means providing an advanced car position signal, with the car control means of an IR car, when selected for second riser service, indicating an advanced car position located in the fictitious floors by incrementing the actual advanced car position signal by N, and supervisory control means responsive to said first and second risers of up and down hall call registering means, to the advanced car position signal, and to the floor enable signals provided by each of said car control means, said supervisory control means including storage means for storing said floor enable signals to obtain the building configuration existing at any instant, as defined by the car controllers means of said plurality of elevator cars, said supervisory control means effectively assigning calls for elevator service registered on said first and second risers of up and down hall call registering means to predetermined cars, using the building configuration stored in said storage means to determine which floors and service directions therefrom are currently in the building configuration, and which floors and service directions therefrom each of the cars is capable of serving, the car controller means of an IR car including means for translating an assignment to a fictitious floor to an actual floor of said building by decrementing each assignment by N.

* * * * *